US007209095B2

(12) United States Patent
Wang

(10) Patent No.: US 7,209,095 B2
(45) Date of Patent: Apr. 24, 2007

(54) POSITIONING STRUCTURE FOR A DUAL-USE ANTENNA AND BASE

(75) Inventor: Chun-Ying Wang, Taipei (TW)

(73) Assignee: Lanready Technologies, Inc., Taipei (TW)

( * ) Notice: Subject to any disclaimer, the term of this patent is extended or adjusted under 35 U.S.C. 154(b) by 47 days.

(21) Appl. No.: 11/221,910

(22) Filed: Sep. 9, 2005

(65) Prior Publication Data

US 2007/0057863 A1 Mar. 15, 2007

(51) Int. Cl.
*H01Q 1/12* (2006.01)

(52) U.S. Cl. ..... 343/888; 343/878

(58) Field of Classification Search ..... 343/888, 343/878, 880, 882, 906
See application file for complete search history.

(56) References Cited

U.S. PATENT DOCUMENTS 4,243,989 A * 1/1981 Piper ..... 343/715
4,282,526 A * 8/1981 Alf et al. ..... 343/715
4,543,584 A * 9/1985 Leer ..... 343/881

* cited by examiner

*Primary Examiner*—Hoang V. Nguyen
(74) *Attorney, Agent, or Firm*—Bacon & Thomas, PLLC

(57) ABSTRACT

A positioning structure for a dual-use antenna and base includes a base having a narrow long hollow pipe wall and a wing board extended externally from two corresponding sides along the hollow pipe wall, and a hollow flange is disposed on the surface of the hollow pipe wall along the vertical direction of the two wing boards, and the back of the two wing boards is connected to a board body, and the board body includes at least one wall hanging hole, so that the base not only can be secured on a desktop, but also can be hanged on a wall by the wall hanging holes.

6 Claims, 4 Drawing Sheets

POSITIONING STRUCTURE FOR A DUAL-USE ANTENNA AND BASE

FIELD OF THE INVENTION

The present invention relates to a positioning structure, and more particularly to a positioning structure for a dual-use antenna and base, enabling the dual-use antenna to be positioned on the base being placed on a desktop or hanged on a wall.

BACKGROUND OF THE INVENTION

As we are living in an era loaded with information and knowledge, information exchanges and communications between people become more important day after day. The era of network has arrived, and thus network and communication technologies including mobile communications and wireless communications are developed rapidly and become very popular. A wireless networking device serves as an advanced communication tool and fulfills the needs of the wireless transmissions for our work and life and also provides other leisure recreations and data compilations. Therefore, people nowadays have more chances of using the wireless networking devices, and these devices play an important role in our busy life and become indispensable from our daily life.

In general, a wireless networking device usually works with an antenna, and the antenna is used for effectively transmitting and receiving signals. Therefore, users can use any wireless networking device to implement the signal transmission between the wireless networking devices through a wireless network access point, so that users can communicate with the outside by using use the wireless networking devices anytime and anywhere to obtain the maximum beneficial results in the shortest time. Refer to FIG. 1 for the schematic view of a prior art antenna and its base.

In FIG. 1, a base 10 is substantially a cylindrical body, and a plurality of threads 11 is disposed on an external wall of one end of the cylindrical body, so that one end of the base 10 is fixed to a wireless networking device (not shown in the figure) by the threads 11, and another end of the cylindrical body is pivotally coupled to an end of an antenna 13 by a pivot 12, and the antenna 13 can be bent to an angle by using the pivot 12 as an axial center. The antenna 13 is a narrow long rod body with a conductive wire (not shown in the figure) coiled inside the rod body, and the conductive wire is used for transmitting and receiving signals. Therefore, users can integrate the wireless networking device, the base 10, and the antenna 13 for transmitting and receiving signals. In the meantime, the pivot 12 is used as the axial center to turn the antenna 13 to an angle for the adjustment to a good signal transmitting and receiving angle.

The inventor of the present invention understands that the simple combination of the foregoing base 10 and the antenna 13 no longer meets the market requirements of the fast development of the wireless networking device and the actual needs of users, since the combination of the prior art base 10 and antenna 13 can only be fixed onto the wireless networking device for its use and limits the flexible use of space of the wireless networking device, and the base 10 and the antenna 13 cannot be provided for both desktop design and wall hanging design. Obviously, the prior art cannot be flexibly used in the space therein, and thus affecting the effect of transmitting or receiving signals by the wireless networking device. Therefore, these issues are the actual problems around wireless networking device manufactures during the assembling and use of the antenna. In view of the worldwide distributions and sales of the wireless networking devices, the manufacture that still stay with the mentioned prior art will hard to be outstanding in the market, if the foregoing problems cannot be solved.

Therefore, the inventor of the present invention based on the actual needs of users to improve the design of the combination of the prior art base 10 and its antenna 13, and simplify its structure by providing a dual-use design that can be used either as a desktop design or a wall hanging design. Such arrangement not only greatly helps the wireless networking device manufactures, but also benefits consumers. Therefore, introducing a multifunctional design is an important subject to the present wireless networking device industry.

SUMMARY OF THE INVENTION

In view of the description above, the inventor of the present invention based on years of experience to conduct extensive researches and experiments to improve the combination of the prior art antenna and its base and finally invented a positioning structure for a dual-use antenna and base in accordance with the present invention.

Therefore, it is a primary objective of the present invention to overcome the shortcomings of the structure of the prior art antenna and its base that cannot provide a desktop use or a use of wall hanging by providing a positioning structure for a dual-use antenna and base, and the positioning structure comprises a base having a narrow long hollow pipe wall, and a wing board extended externally from two corresponding sides along the hollow pipe wall, and a hollow flange disposed on the surface of the hollow pipe wall along the vertical direction of the two wing boards, and the back of the two wing boards is connected to a board body, and the board body includes at least one wall hanging hole, so that the base not only can be secured on a desktop, but also can be hanged on a wall by the wall hanging holes. Further, an antenna is inserted into the flange and used for the desktop design, or the antenna can be inserted into the hollow pipe wall, and a section is exposed to the outside; wherein the antenna is a narrow long rod body, and a conductive wire is coiled inside the rod body and one end of the conductive wire is extended outwardly from an end of the rod body, and one end of the hollow pipe wall is extended outward, such that the conductive wire produces a wire management effect by the hollow pipe wall, and the base and the antenna can achieve the dual-use purpose (for desktop use and for wall hanging use), as well as achieving the positioning effect. The space of the antenna can be used flexibly to obtain a good angle for transmitting and receiving signal as well as maximizing the beneficial results of the base.

Further, a narrow long groove is disposed on the surface of the base and along the side walls of the hollow pipe wall and the hollow flange, such that the hollow pipe wall and the hollow flange have an elastic clamping property, and the external diameter of one end of the rod body of the antenna is larger than the external diameter of another end; wherein the end of the rod body having a larger external diameter is inserted into the flange for the use as a desktop design, and the end of the rod body having a smaller external diameter is extended into an end of the hollow pipe wall, and a section of the other end is exposed to the outside for the use as a wall hanging design.

The above and other objects, features and advantages of the present invention will become apparent from the following detailed description taken with the accompanying drawings.

DETAILED DESCRIPTION OF THE PREFERRED EMBODIMENTS

Figure 1:
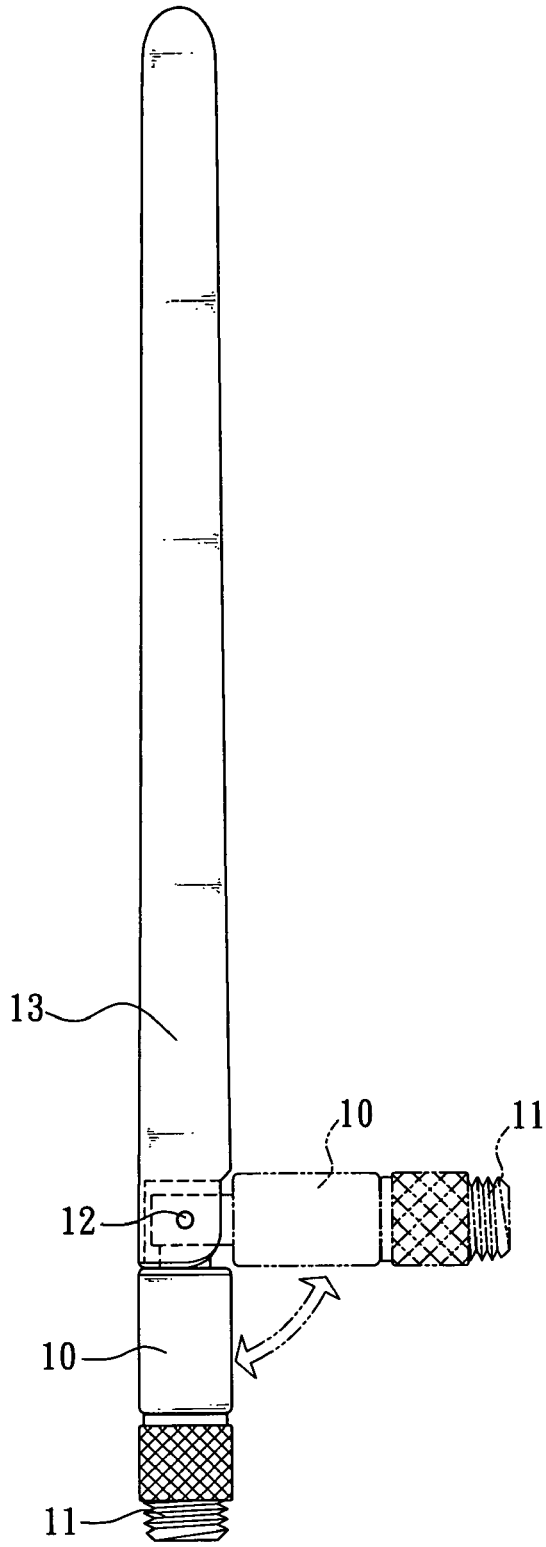
FIG. 1 (Prior Art)
FIG. 1 is a schematic view of a prior art antenna and its base.
Figure 2:
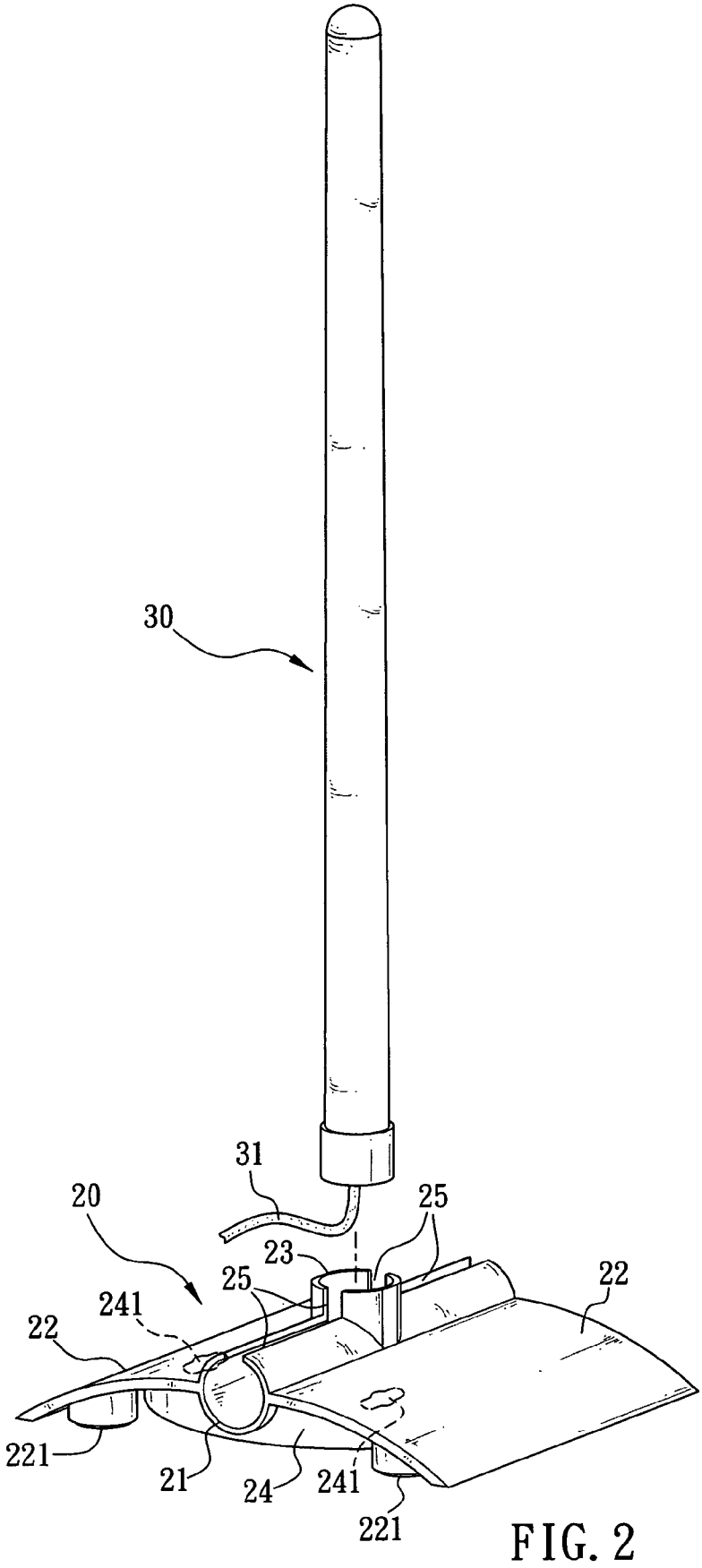
FIG. 2 is a schematic view of an antenna and its base of the present invention.

Referring to FIG. 2 for the positioning structure for a dual-use antenna and base in accordance with the present invention, the position structure comprises a base 20 and an antenna 30. The base 20 comprises a narrow long hollow pipe wall 21 and a curved wing board 22 separately extended outward from two corresponding sides of the hollow pipe wall 21; wherein a hollow flange 23 is disposed on the surface of the hollow pipe wall 21 and vertical to the two wing boards 22, and at least one wall hanging hole 241 (which is disposed on the left and right positions of the board body in this embodiment) is disposed on a board body 24 coupled to the back of the two wing boards 22, such that the wall hanging hole 241 can be used for hanging the base 20 on a wall. In addition, at least one footer 221 is installed at the back of the two wing boards 22, such that the installation of the footer 221 and the board body 24 secures the base 20 on a desktop or other fixed object (such as hanging on a wall).

In FIG. 2, the antenna 30 is a narrow long rod body, and the external diameter of an end of the rod body is larger than the external diameter of another end; wherein the end of rod body having a larger external diameter is compliant with the design of the flange 23 on the surface of the base 20 and inserted into the flange 23, and a conductive wire 31 is coiled inside the rod body and is used for transmitting and receiving signals. In the meantime, one end of the conductive wire 31 is extended out of an end of the rod body having a larger external diameter, and extended outward from an end of the hollow pipe wall 21 on the surface of the base 20, so that the conductive wire 31 can achieve a wire management effect automatically with the design of the hollow pipe wall 21.

Further, a narrow long groove 25 is disposed on the surface of the base 20 and along the side walls of the hollow pipe wall 21 and the hollow flange 23, such that the design of the narrow long groove 25 provides an elastic clamping property to the hollow pipe wall 21 and the hollow flange 23. Therefore, the antenna 30 can effectively clamp the hollow pipe wall 21 or the hollow flange 23 by the elastic clamping property of the narrow long groove 25 to secure the antenna 30 with the hollow pipe wall 21 or the hollow flange 23 together.

Figure 3:
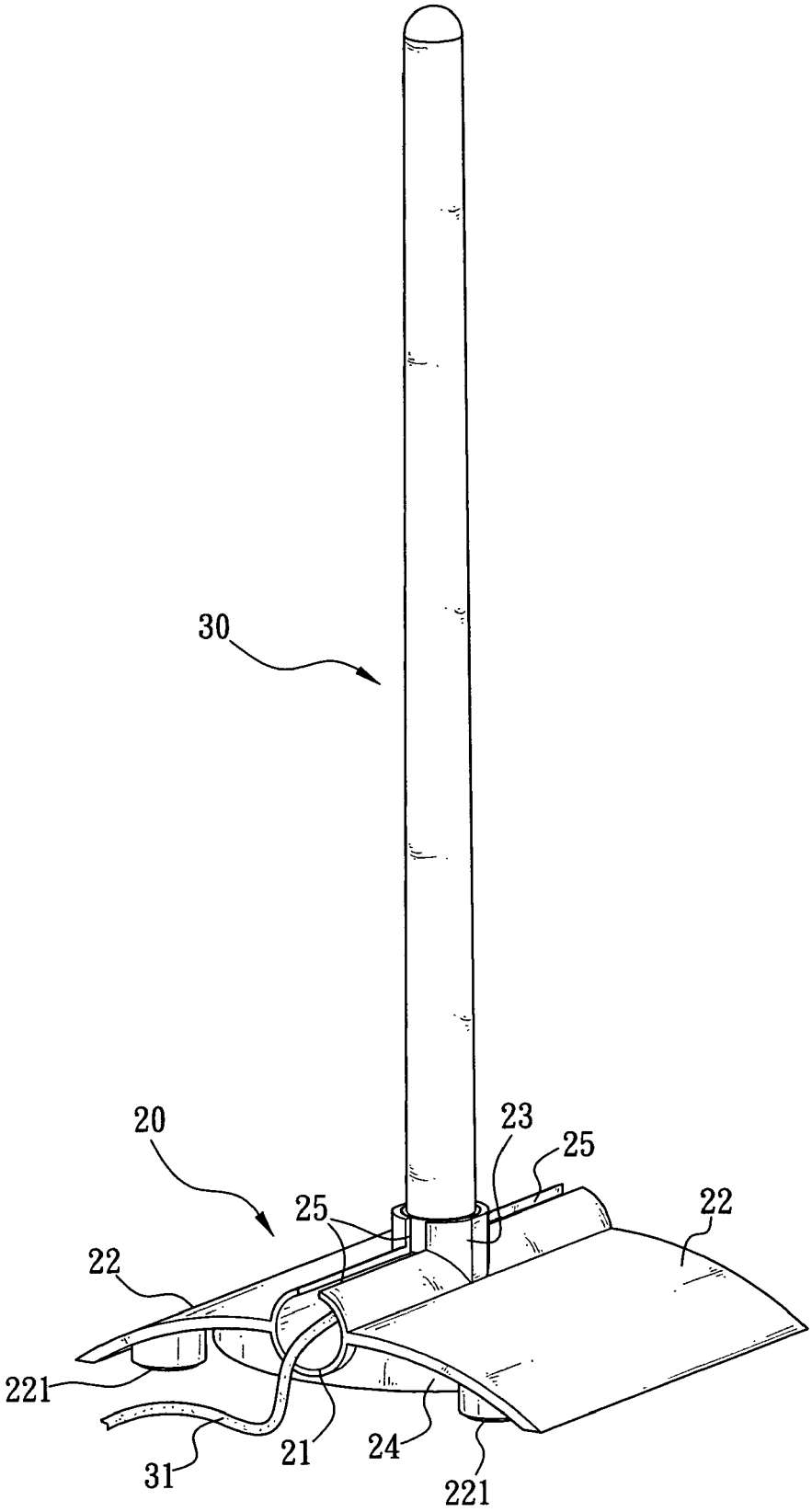
FIG. 3 is a schematic view of assembled antenna and base as depicted in FIG. 2 and used as a desktop antenna.

Referring to FIG. 3, it is clear that the base 20 can be secured onto a desktop by the foregoing components, and the end of the antenna 30 having a larger external diameter is inserted into the flange 23 of the base 20 while the conductive wire 31 of the antenna 30 is extended to the outside from an end of the hollow pipe wall for the use in a desktop design.

Figure 4:
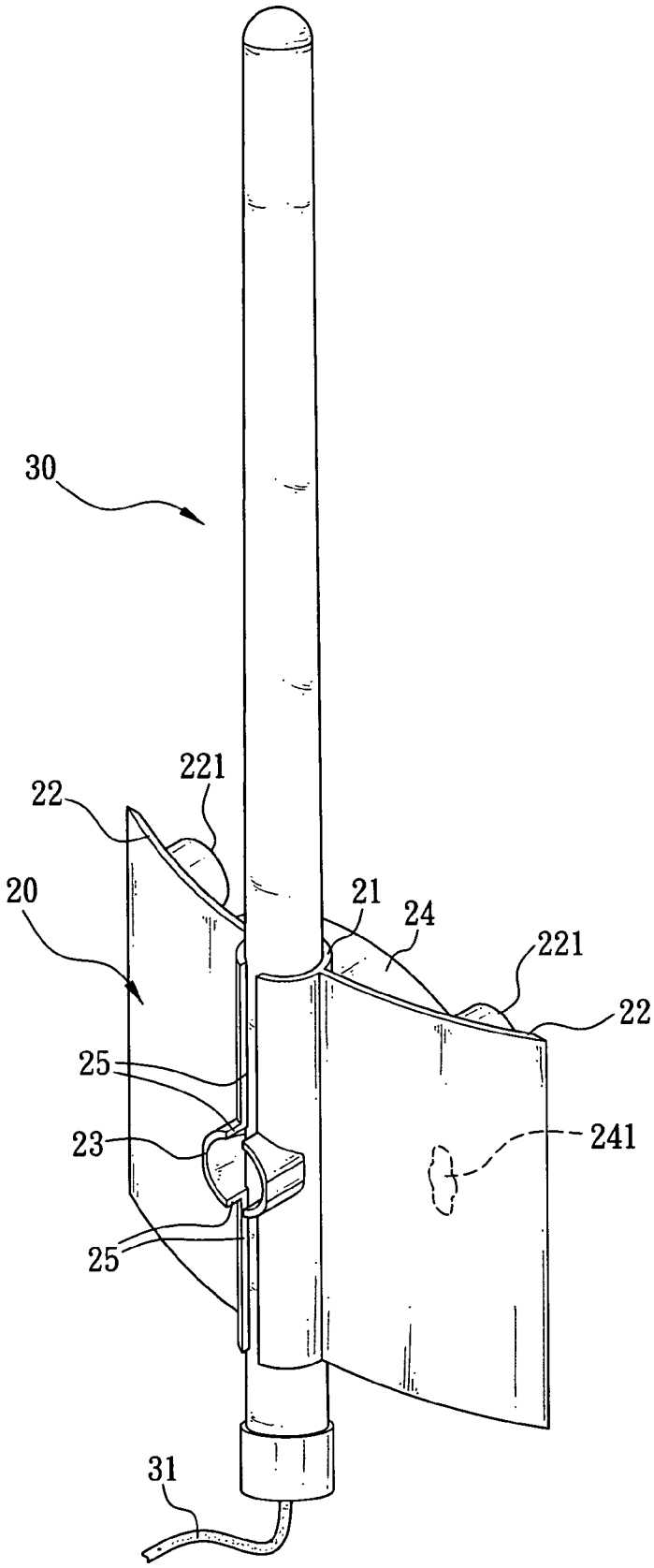
FIG. 4 is a schematic view of assembled antenna and base as depicted in FIG. 2 and used as a wall hanging antenna.

Referring to FIG. 4, the base 20 can be hung on a wall by the wall hanging holes 241 at the back of the board body 24, and the other end of antenna 30 having a smaller external diameter is extended into an end of the hollow pipe wall 21, and a section of another end is exposed from the hollow pipe wall 21, so that the end of the antenna 30 having a larger external diameter is clamped securely by the hollow pipe wall 21 for the use in a wall hanging design.

Therefore, the most outstanding feature of the present invention resides on the positioning structure having a base 20 that is designed for the use on a desktop as shown in FIG. 3 as well as hanging on a wall as shown in FIG. 4. With the positioning structure, the antenna 30 is dual-use (referring to the desktop design and the wall hanging design) while effectively achieving the positioning effect and the antenna 30 can flexibly be used in the space thereof to obtain a good angle for transmitting and receiving signals and maximizing the beneficial result of the antenna 30 and the base 20.

In summation of the description above, the present invention not only comes with a simple structure, but also effectively overcomes the shortcomings of the prior art whose antenna cannot be used flexibly, and can only be fixed onto a wireless networking device for its use and cannot be used for both the desktop design and the wall hanging design. Therefore, the present invention has improved over the prior art.

While the invention herein disclosed has been described by means of specific embodiments, numerous modifications and variations could be made thereto by those skilled in the art without departing from the scope and spirit of the invention set forth in the claims.

What is claimed is:

1. A positioning structure for a dual-use antenna and base, comprising:

a base, being comprised of a narrow long hollow pipe wall and a wing board separately extended outward from two corresponding sides along said hollow pipe wall, and a hollow flange being disposed on the surface of said hollow pipe wall and perpendicular to said two wing boards, and a board body being coupled to the back of said two wing boards, and said board body including at least one wall hanging hole; and an antenna, being a narrow long rod body, and an end of said rod body being inserted into said flange on the surface of said base or said rod body being inserted into said hollow pipe wall, with a section exposed to the outside.

2. The positioning structure for a dual-use antenna and base of claim 1, wherein said base comprises a narrow long groove disposed on the surface of said base along the side walls of said hollow pipe wall and said hollow flange, such that said hollow pipe wall and said hollow flange have an elastic clamping property.

3. The positioning structure for a dual-use antenna and base of claim 2, wherein a conductive wire is coiled inside said rod body, and one end of said conductive wire is extended outward from an end of said rod body into said narrow long groove on said hollow pipe wall, and then extended from an end of said hollow pipe wall to the outside.

4. The positioning structure for a dual-use antenna and base of claim 3, wherein said rod body has an external diameter at one end larger than the external diameter of another end, and the end having a larger diameter is inserted in said flange.

5. The positioning structure for a dual-use antenna and base of claim 4, wherein said rod body with a smaller external diameter is extended into an end of said hollow pipe wall, and a section of another end of said hollow pipe wall is exposed to the outside.

6. The positioning structure for a dual-use antenna and base of claim 1, wherein said two wing boards comprise at least one footer at the back of said wing boards.

* * * * *